US009000909B2

(12) United States Patent
Batchelder et al.

(10) Patent No.: US 9,000,909 B2
(45) Date of Patent: Apr. 7, 2015

(54) SYSTEM AND METHOD FOR GENERATING PROTECTIVE OBSCURING HAZE

(71) Applicant: Convey Technology, Inc., Somers, NY (US)

(72) Inventors: Cynthia Trempel Batchelder, Somers, NY (US); J. Samuel Batchelder, Somers, NY (US); Luke Batchelder, Somers, NY (US); James Batchelder, Somers, NY (US)

(73) Assignee: Convey Technology, Inc., Somers, NY (US)

( * ) Notice: Subject to any disclaimer, the term of this patent is extended or adjusted under 35 U.S.C. 154(b) by 38 days.

(21) Appl. No.: 13/859,977

(22) Filed: Apr. 10, 2013

(65) Prior Publication Data

US 2014/0306818 A1 Oct. 16, 2014

(51) Int. Cl.
*G08B 23/00* (2006.01)
*G08B 15/02* (2006.01)

(52) U.S. Cl.
CPC ..... *G08B 15/02* (2013.01)

(58) Field of Classification Search
CPC ..... G08B 15/02
USPC ..... 340/501, 584, 628, 539.11, 539.13, 340/504, 540, 541; 73/655
See application file for complete search history.

(56) References Cited

U.S. PATENT DOCUMENTS 5,233,927 A * 8/1993 Wulvik ..... 102/334
5,917,775 A * 6/1999 Salisbury ..... 367/93
2002/0003470 A1* 1/2002 Auerbach ..... 340/425.5
2011/0169633 A1* 7/2011 Lauder et al. ..... 340/539.13
2012/0229275 A1* 9/2012 Mattern ..... 340/540

OTHER PUBLICATIONS

"Health Hazard Evaluation (HHE) report", National Institute for Occupational Safety and Health, 1994, 101 pages.

Sunil Varughese et al., "Effects of Theatrical Smokes and Fogs on Respiratory Health in the Entertainment Industry", American Journal of Industrial Medicine, 2005, 47:pp. 411-418.

http://www.theatrefx.com/store/commerce.cgi?product=professional Joggers, "Professional Foggers", Datasheet, Published prior to Apr. 10, 2013.

http://www.smokecloak.ca/en/, "SmokeCloak", Datasheet, Published prior to Apr. 10, 2013.

* cited by examiner

*Primary Examiner* — Tai T Nguyen
(74) *Attorney, Agent, or Firm* — Westman, Champlin & Koehler, P.A.

(57) ABSTRACT

A system and method of providing a protective cover to occupants of a room, which includes detecting an occurrence of a threatening event with a protection system deployed in the room, such as detecting gunfire with the protection system and/or receiving a transmitted command of the threatening event by the protection system, and emitting an obscuring haze into the room from a haze generator of the protection system in response to the detected occurrence of the gunfire. The emitted obscuring haze obscures the light of sight contact between a shooter and the occupants in the room, which provides a measure of cover for the occupants while other assistance is being organized. This reduces the chances that the shooter will be able to accurately shoot any victim, increasing the odds of victim survival.

20 Claims, 3 Drawing Sheets

FIG. 1
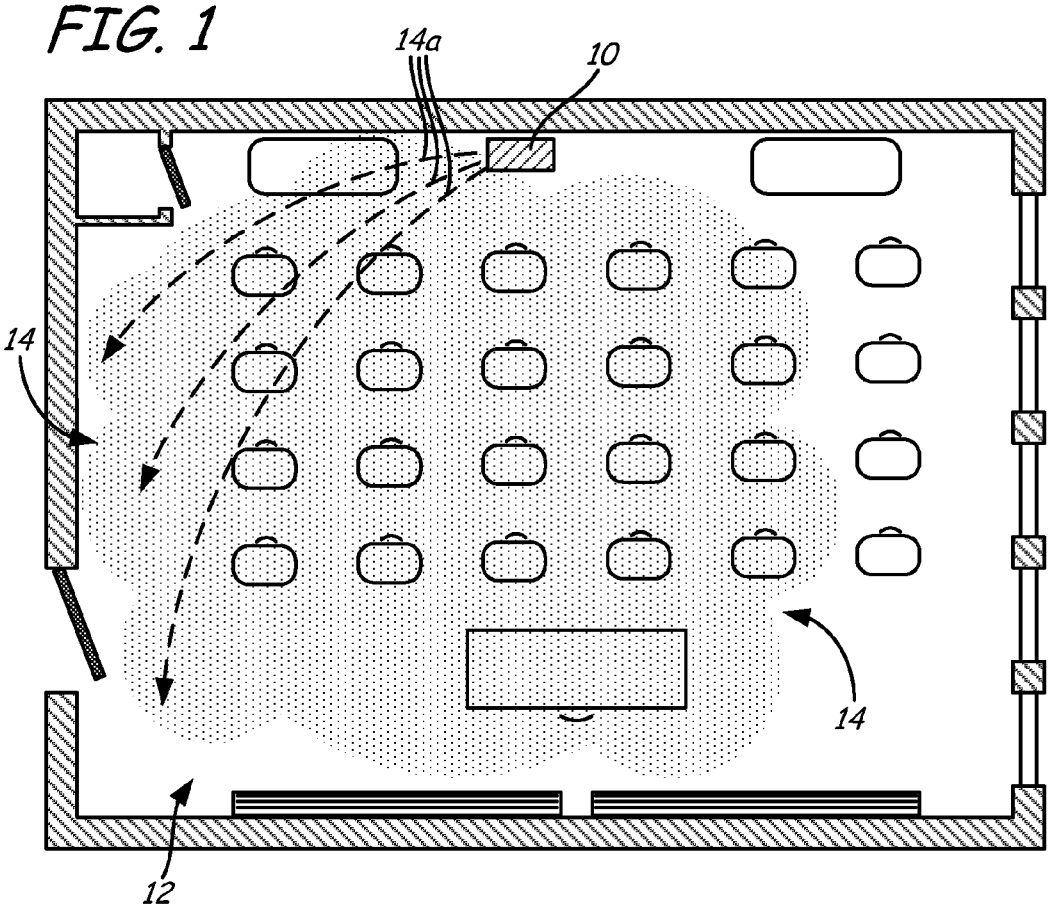
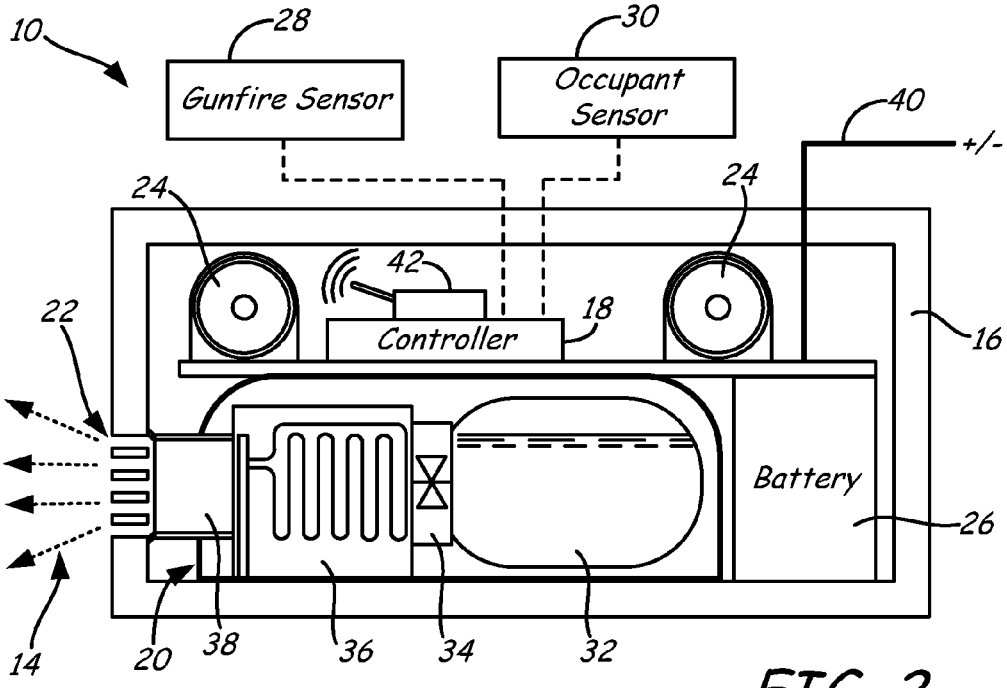
FIG. 2

SYSTEM AND METHOD FOR GENERATING PROTECTIVE OBSCURING HAZE

BACKGROUND

The present disclosure is directed to techniques for protecting people in response to threatening events. In particular, the present disclosure is directed to a system and method for detecting threatening events and for generating an obscuring haze, such as fog, smoke, and the like, when such events are detected to protect people in the vicinity.

Firearm violence is a continuing political issue over firearm rights versus public safety, particularly in view of the recent surge in high-profile mass shootings, such as with the 1999 Columbine High School shootings, the 2007 Virginia Tech shootings, the 2009 Binghamton shootings, the 2009 Fort Hood shootings, the 2012 Aurora movie theater shootings, the 2012 Minneapolis Accent Signage Systems shootings, and the 2012 Sandy Hook Elementary School shootings, for example. In addition to the emotional and physical losses incurred during these events, which is of paramount concern to many people, the mass shootings also costs billions of dollars in medical expenses, legal challenges, political fights, and other associated issues. These tragedies, unfortunately, are not unique. But, they emphasize the need to explore alternative options to reduce the efficacy of firearms turned against defenseless people, particularly in view of the political issues involving firearm rights.

Historically, battlefield smoke screens have been used successfully to deny an opponent vision and accuracy. They are particularly useful in reducing the effectiveness of range weapons. However, many of such smoke screens can be harmful upon exposure, such as chemically-generated smokes produced from titanium tetrachloride, zinc chloride, chlorosulfuric acid, and phosphorus. As such, there is also a need for use of smoke screens that are not harmful to those exposed to the smoke.

SUMMARY

An aspect of the present disclosure is directed to a protection system that includes a haze generator (e.g., a fog or smoke generator), a gunfire sensor configured to detect an occurrence of gunfire, and a communication unit configured to communicate with one or more external devices. The protection system also includes a controller in signal communication with the haze generator, the gunfire sensor, and the communication unit, and configured to manage the haze generator to generate and emit an obscuring haze into an environment in which the protection system is deployed in response to the detected occurrence of the gunfire by the gunfire sensor and/or in response a transmitted command received by the communication unit.

Another aspect of the present disclosure is directed to a method of providing a protective cover to occupants of a room. The method includes detecting a threatening event with a protection system deployed in the room, where the threatening event includes detecting an occurrence of gunfire with the protection system and/or receiving a transmitted command of the threatening event by the protection system. The method also includes emitting an obscuring haze into the room from a haze generator of the protection system in response to the detected threatening event.

Another aspect of the present disclosure is directed to a method of providing a protective cover to occupants of a plurality of rooms. The method includes deploying at least one protection system in each of the plurality of rooms, and managing an operating state of each protection system in response to occupant presence in the room in which the protection system is deployed such that the protection system is maintained in a ready state when occupants are in the room in which the protection system is deployed. The method also includes transmitting a command of a threatening event to at least a portion of the protection systems, generating an obscuring haze from a haze generator of each protection system that receives the transmitted command, and emitting the generated obscuring haze into the room in which the protection system is deployed.

DEFINITIONS

Unless otherwise specified, the following terms as used herein have the meanings provided below:

The terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the present disclosure.

The term "providing", such as for "providing a device", when recited in the claims, is not intended to require any particular delivery or receipt of the provided item. Rather, the term "providing" is merely used to recite items that will be referred to in subsequent elements of the claim(s), for purposes of clarity and ease of readability.

The terms "about" and "substantially" are used herein with respect to measurable values and ranges due to expected variations known to those skilled in the art (e.g., limitations and variabilities in measurements).

BRIEF DESCRIPTION OF THE DRAWINGS

FIG. 1 is a top schematic illustration of a protection system of the present disclosure deployed in a room.

FIG. 2 is a side schematic illustration of an example embodiment of the protection system.

DETAILED DESCRIPTION

Figure 3:
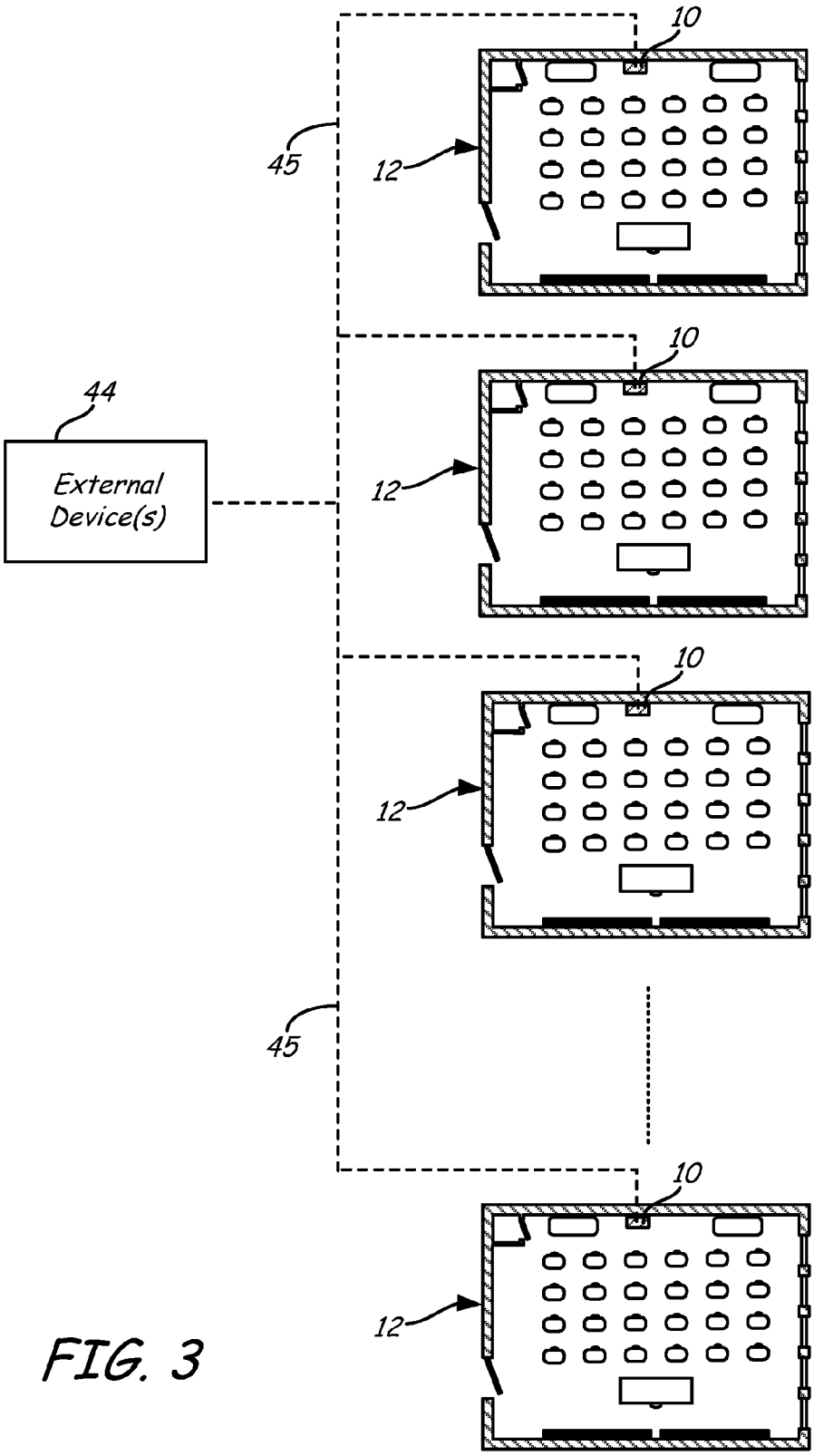
FIG. 3 is a schematic illustration of multiple protection systems deployed in separate rooms, and communicating with one or more external devices.

The present disclosure is directed to a protection system for detecting when a firearm is discharged, and for generating an obscuring haze (e.g., fog, smoke, and the like) when such an event is detected. The protection system is preferably deployed in an enclosed room or similar environment, such as a school classroom, office, residential room, store, restaurant, and the like, that people may occupy. Such enclosed locations typically reduce the number of escape routes that occupants may have if a firearm wielder enters the room, thereby subjecting the people to a threatening situation if the firearm wielder decides to shoot at them. Additionally, because the enclosed nature of school classrooms, offices, residential rooms, stores, and restaurants, the firearm wielder may have easy line of sight towards each person in the room, rendering them easy targets.

In response to this issue, the protection system of the present disclosure is configured to rapidly respond to a threatening event, such as when detecting the acoustic signature of gunfire (e.g., an overpressure waveform and/or an acoustic frequency of gunfire), and/or upon receipt of a transmitted command to respond to the threatening event. In response, the protection system rapidly generates and emits an obscuring haze into the room to prevent a shooter from having line of sight contact with the potential victims. For example, FIG. 1 illustrates protection system 10 deployed in room 12 to generate and emit fog 14 (or other obscuring haze) when needed, where room 12 is illustrated as a school classroom, but may alternatively be any other suitable enclosed room or environment in which occupants may be located.

Protection system 10 may be deployed at any suitable location within room 12. For example, protection system 10 may be mounted at a rear location in room 12 to remain out-of-the way of occupant traffic. Alternatively, protection system 10 may be installed into a wall of room 12 or furniture in room 12 (e.g., in a cabinet, shelf, or other suitable article). Preferably, protection system 10 is positioned such that it is not obstructed by other articles or occupants during use, allowing fog 14 to readily fill into room 12.

As can be appreciated, if a firearm wielder enters room 12 containing occupants, the occupants may be trapped without any quick means to escape, and the firearm wielder may have good line of sight contact with each occupant. If the firearm wielder discharges the firearm, protection system 10 rapidly generates and emits fog 14 or other obscuring haze into room 12, which obscures the light of sight contact between the shooter and the occupants in the room. This provides a measure of cover for the occupants while other assistance is being organized, and reduces the chances that the firearm wielder will be able to accurately shoot any victim, greatly increasing the odds of victim survival.

In addition, the generated fog 14 (or other obscuring haze) may provide a visual aide to law enforcement and other security personnel as to where the gunshots occurred. This can assist them in readily tracking down the shooter. Moreover, due to the loud muzzle blasts associated with gunfire, protection system 10 is also preferably configured to detect the acoustic signature of gunfire that occurs in adjacent rooms, allowing fog 14 (or other obscuring haze) to be generated prior to the shooter entering room 12.

Protection system 10 may generate an obscuring haze, such as fog 14, using any suitable technique that provides a sufficient level of obscuration. For example, protection system 10 may emit the obscuring haze as fog 14, as smoke, or a combination thereof. Preferably, protection system 10 emits fog 14 to reduce any negative impact on the occupants of room 12. In some embodiments, fog 14 may be generated as a chilled fog from a carbon dioxide gas or solid, or by liquid nitrogen interacting with water.

Alternatively, and more preferably, protection system 10 may generate fog 14 as a heated fog, such as by heating and vaporizing a volatile fluid ("fog oil" or "fog juice"), and mixing the vapor with cooler air to re-condense particles to a few microns across. These particles are large enough that they efficiently scatter light, yet small enough that Brownian motion keeps them aloft. Suitable volatile fluids for use in generating the fog include glycols of ethylene, propylene, 1,3-butylene, diethylene, and triethylene, along with compositions such as mineral oil.

Fog 14 is preferably dense enough to provide good obscuration, and in some preferred embodiments, is also opaque in the near infrared spectrum. In the Mie scattering regime, the scattering cross section for a droplet of fog 14 is very roughly about twice the cross sectional area of the droplet. Typically, if the droplets of fog 14 are optimally positioned so as to not shadow each other, the mass of 2-micron droplets required to obscure a square meter is about 700 milligrams.

The longer the path length through fog 14, the less concentrated the droplets have to be to achieve obscuration. However, in the relatively confined space of room 12, the concentration of the droplets in fog 14 are preferably at least about 100 milligrams/cubic meter, and more preferably at least about 120 milligrams/cubic meter, to provide sufficient visual coverage.

Depending on the composition of the volatile fluid used to generate fog 14, fog 14 may have a peak exposure limit, above which may result in coughing, dry throat, headaches, dizziness, drowsiness, and tiredness. While these are unfortunate potential symptoms, they are substantially outweighed by the increased protection made available by fog 14. However, in some embodiments, the concentration of the droplets in fog 14 may be less than the peak exposure limit, such as less than about 150 milligrams/cubic meter, and more preferably less than about 130 milligrams/cubic meter.

Furthermore, in embodiments in which fog 14 is also opaque in the near infrared spectrum, the droplets of fog 14 preferably have larger droplet sizes, such as from about 5 microns to about 10 microns. As discussed below, protection system 10 may also emit visible and/or infrared light into fog 14 to further enhance the obscuration properties of fog 14.

FIG. 2 illustrates an example embodiment for protection system 10. As shown, protection system 10 may include housing 16, controller 18, fog generator 20, vent 22, light sources 24, battery 26, gunfire sensor 28, and occupant sensor 30. Housing 16 is a casing for the components of protection system 10, and in a preferred embodiment, includes a sufficient level of armoring to prevent a firearm wielder from readily destroying protection system 10 by shooting at it.

Upon generating and emitting fog 14, a natural reaction of the firearm wielder may be to shoot at protection system 10 to destroy it before additional fog 14 is generated. However, housing 16 may be sufficiently bulletproof to allow protection system 10 to continue to operate after receiving multiple gunshots. Examples of suitable armors for housing 16 include soft armors to prevent spallation onto adjacent people, such as polycarbonate resin-based armors commercially available under the trademark "LEXAN" from SABIC Innovative Plastics, Pittsfield, Mass.

Controller 18 is one or more control circuits configured to manage the operation of the components of protection system 10, as discussed below. For example, one or more of the control functions performed by controller 18 can be implemented in hardware, software, firmware, and the like, or a combination thereof. Controller 18 is preferably connected to fog generator 20, light sources 24, battery 26, gunfire sensor 28, and occupant sensor 30 via one or more communication and power lines (electrical, optical, and/or wireless lines, not shown).

Fog generator 20 is a unit configured to generate bursts of fog 14 or other obscuring haze based on control signals from controller 18. For example, fog generator 20 may be a heated fog generator that includes a reservoir 32 for a volatile fluid, a flow regulator 34 for pumping or otherwise regulating flow of the volatile fluid from reservoir 32, a heat exchanger 36 for heating and vaporizing the volatile fluid, and a manifold 38 for directing the generated vaporized fluid to vent 22, where the vaporized fluid may condense with cooler air to generate fog 14.

Vent 22 is an opening in housing 16 through which fog 14 is emitted, and through which atmospheric air can enter protection system 10 (e.g., to condense the droplets). Protection system 10 is preferably positioned such that vent 22 directs the emitted fog 14 generally towards a region that is between a doorway or other access point in room 12 through which a potential firearm wielder may enter, and the expected locations of the room's occupants, as illustrated by arrows 14*a* in FIG. 1. However, as also illustrated in FIG. 1, fog 14 may rapidly fill the bulk of room 12, providing a cloud-like cover for the occupants, rather than merely a wall-like cover. The cloud-like cover increases the obscuration depth compared to a wall-like cover, thereby reducing visibility through fog 14.

Fog generator 20 and vent 22 may emit fog 14 at any suitable flow rate to rapidly fill room 12. Examples of suitable flow rates include at least about 10,000 cubic-feet of fog 14/minute, more preferably at least about 15,000 cubic-feet of fog 14/minute, and even more preferably at least about 20,0000 cubic-feet of fog 14/minute. In comparison, a 40-foot by 40-foot by 12-foot room has a volume of about 19,000 cubic feet. As such, reservoir 32 of fog generator 20 preferably contains a sufficient supply of the volatile fluid to generate enough fog 14 to fill or substantially fill room 22, in this case, a supply sufficient to generate a burst of fog 14 for about sixty seconds.

In some embodiments, reservoir 32 contains a sufficient supply of the volatile fluid to generate fog 14 multiple times (for multiple threatening events and/or test drills). Because of the secure nature of housing 16, which is preferably tamper resistant, it may be difficult to refill reservoir 32 after it exhausts its supply of the volatile fluid. As such, in this embodiment, protection system 10 is preferably capable of generating fog 14 to fill or substantially fill room 12 (or any other suitable room) multiple times before requiring refilling or replacement. Alternatively, protection system 10 may have a securable access port (not shown) for refilling reservoir 32, which is also preferably tamper resistant without appropriate access keys or tools.

A sixty-second burst may initially appear to be a long time to generate a covering fog 14 in room 12 if a firearm wielder begins discharging a weapon. However, because vent 22 preferably directs the emitted fog 14 generally towards a region that is between the potential firearm wielder and the room's occupants (e.g., along arrows 14*a* in FIG. 1), a sufficient covering of fog 14 may be generated in this region within a few seconds. The remaining regions of room 12 may then be filled with fog 14 to provide sufficient cover for the room's occupants regardless of location within room 12.

Additionally, as discussed below, protection system 10 is preferably capable of receiving transmitted commands in response to threatening events. For example, protection system 10 may receive a transmitted command to generate fog 14 from a central office of the building in which protection system 10 is deployed. This allows fog 14 to be rapidly generated and emitted to fill room 12 (e.g., within about one minute). As such, in this case, fog 14 can fill room 12 prior to a shooter entering.

Furthermore, depending on the position of furniture and occupants in room 12, the flow pattern of fog 14 emitted from vent 22 may create pockets of relatively low fog density. As such, in some preferred embodiments, vent 22 may include one or more actuatable louvers that change positions over time (e.g., oscillate back and forth) to change the direction of the flow pattern of fog 14 from vent 22. This can assist in reducing these pockets and in increasing the rate at which fog 14 fills room 12.

Light sources 24 are configured to shine light into fog 14 to further obscure a shooter's ability to see through fog 14. Light sources 24 may be any suitable type of light source, such as strobe and/or halogen lights. In some embodiments, light sources 24 may also have infrared content to assist in further blinding infrared viewers. In additional embodiments, light sources 24 may also adjust in illumination intensity and/or emission directions (e.g., oscillate back and forth) to further assist in reducing visibility through fog 14, and to mask movements by the occupants in room 12.

Battery 26 is one or more rechargeable backup batteries configured to run protection system 10 in the event that external power is cut. Typically, protection system 10 may be powered by an external power source with electrical line 40, where electrical line 40 may direct electrical power to battery 26 in a trickle-charging manner, and battery 26 may provide electrical power to controller 18, fog generator 20, any actuating lovers of vent 22, light sources 24, gunfire sensor 28, and occupant sensor 30. However, if electrical line 40 is cut or the external power is otherwise lost, battery 26 itself may electrically power the components of protection system 10 for a sufficient duration. In this case, controller 18 also preferably transmits a signal via communication unit 42 to notify users that ground power to protection system 10 has been lost and/or when battery 26 runs low.

Gunfire sensor 28 is a sensor configured to detect an occurrence of gunfire. In a preferred embodiment, gunfire sensor 28 is an electroacoustic transducer such as a microphone or other suitable transducer configured to detect the acoustic signature of gunfire, such as an overpressure waveform and/or an acoustic frequency of gunfire. In particular, gunfire sensor 28 may receive acoustic signals from the environment around protection system 10 (e.g., within room 12 and/or adjacent rooms), perform an analog-to-digital conversion of the acoustic signals, and transmit the resulting digital signals to controller 18. Controller 18 may then compare the received digital signals to predetermined patterns typically associated with acoustic signatures of gunfire.

In a first embodiment, gunfire sensor 28 may digitize signals corresponding to "overpressure waveforms" of the received acoustic signals. For example, a typical firearm discharge generates an impulse sound wave with a sound pressure level (SPL) above a given decibel level (or within a given decibel range). As such, controller 18 may determine whether the received digital signals correspond to an overpressure waveform that is typical for gunfire within above this SPL level (or within the SPL range), such as SPLs of at least about 120 decibels, and more preferably from about 130 decibels to about 180 decibels. If such a condition is detected, controller 18 may then interpret this as a start-up event to generate fog 14 and illuminate light sources 24.

Alternatively, in a second embodiment, gunfire sensor 28 may digitize signals corresponding to "acoustic frequencies" of the received acoustic signals. A typical firearm discharge also generates an acoustic frequency that falls within a given frequency range. As such, controller 18 may determine whether the received digital signals correspond to an acoustic frequency that is typical for gunfire within this frequency range.

The particular frequency range in this embodiment may vary depending on the deployment use of protection system 10. In a typical small-room deployment, such as in a school classroom, office, residential room, store, restaurant, and the like, where the typical assailant firearm is a small-arms weapon, such as a pistol, shotgun, or semi-automatic rifle, the frequency range may range from about 150 hertz to about 2,500 hertz (e.g., with peak acoustic frequencies ranging from about 500 hertz to about 1,500 hertz). If such a condition is detected, controller 18 may then interpret this as a start-up event to generate fog 14 and illuminate light sources 24.

As can be appreciated, many non-gunfire activities can produce acoustic frequencies that fall within the frequency range of gunfire (e.g., vehicle backfiring). As such, in a third embodiment, gunfire sensor 28 may digitize signals corresponding to the overpressure waveforms and to the acoustic frequencies of the received acoustic signals. In this case, controller 18 may determine whether the received digital signals correspond to an overpressure waveform that is typical for gunfire within the SPL range, and may also determine whether the received digital signals correspond to an acoustic frequency that is typical for gunfire within the frequency range. If both of these conditions are met, controller 18 may then interpret this as a start-up event to generate fog 14 and illuminate light sources 24.

A common issue with heated fog generators, is that the heat exchanger of the fog generator typically requires a warm-up period before fog may be generated. For example, heat exchanger 36 of fog generator 20 may require a few minutes (e.g., five minutes) to warm up to a ready state before it can begin vaporizing the volatile fluids to generate fog 14. To provide effective fog cover in a timely manner, this warm up to the ready state needs to occur prior to the detection of gunfire. In other words, heat exchanger 36 is preferably warmed up and made ready for immediate use at all times when room 12 is occupied.

However, it is also undesirable to have heat exchanger 36 warmed up and consuming electrical power at all times. For example, if a given school has fifty classrooms and a protection system 10 in each classroom, this can substantially increase electrical costs if the heat exchanger 36 of each protection system 10 is warmed up at all times.

Instead, protection system 10 may include occupant sensor 30, which may be one or more sensors configured to detect when occupants are in room 12 (or any other suitable room). The particular sensing technique may vary depending on the particular environment of room 12, such as acoustic detection, infrared motion, visual motion, capacitance, and the like. Accordingly, when occupant sensor 30 does not detect the presence of any occupants in room 12 are a sufficient duration (e.g., a thirty or sixty minute timeout period), controller 18 may direct heat exchanger 36 to cool down to a standby temperature to conserve electrical power.

However, if occupant sensor 30 detects the presence of one or more people in room 12, controller 18 may direct heat exchanger 36 to warm up to its operating temperature such that protection system 10 is in its ready state for immediate use upon detection of gunfire. In alternative (or additional embodiments), controller 18 may switch heat exchanger 36 between its standby and operating temperatures based on preset time periods. For example, controller 18 may be set to warm heat exchanger 36 up during time periods in which room 12 is expected to be occupied, such as during normal classroom hours. Outside of this time period, controller 18 may cool heat exchanger 36 down to its standby temperature such that protection system 10 is in its standby state.

While illustrated as being outside of housing 16, gunfire sensor 28 and occupant sensor 30 are preferably retained at least partially within housing 16 to protect them from damage and tampering. For example, housing 16 may include small openings through which gunfire sensor 28 and occupant sensor 30 may operate. Furthermore, light sources 24 are also preferably protected by housing 16, while also allowing the emitted light to shine from protection system 10. For example, housing 16 may include reinforced transparent windows that are preferably damage and tamper resistant (e.g., bulletproof), while also allowing light to emit therethrough.

Protection system 10 may also include one or more communication units 42, which allow controller 18 to communicate with one or more external devices, such as external computers, dedicated servers, cloud servers, laptop computers, smart phones, portable media players, personal digital assistants (PDAs), tablet devices, and the like. For example, as shown in FIG. 3, one or more external devices 44 may communicate with protection systems 10 over one or more encrypted communication lines 45, which may be wired communication lines (e.g., hardwired local area networks), wireless communication lines (e.g., cellular wide area networks and Wi-Fi local area networks), or combinations thereof.

This arrangement allows the external devices 44 to transmit commands to the controller 18 of each protection system 10. For example, an external device 44, such as a smart phone or tablet, may include an application, widget, or other software allowing a user to remotely interface with the protection systems 10 to transmit various commands to one or more of the protection systems 10, such as commands to warm up heat exchangers 36, to perform self-diagnostic checks, and the like.

Additionally, the external device 44 may transmit a command to initiate a start-up event in one or more of protection systems 10 to generate fog 14 in the respective rooms 12 and to illuminate light sources 24. This can be beneficial if a threatening event is imminently expected, allowing a user to remotely generate and emit covering fog 14 in each room 12 prior to a shooter entering rooms 12 and prior to any actual firearm discharge. Because each protection system 10 is preferably in its ready state while rooms 12 are occupied, each protection system 10 may rapidly generate and emit fog 14 into each room 12 of the building (or portions thereof) to protect the occupants. As mentioned above, being in the ready state allows each protection system 10 to immediately being to fill each room 12 with fog 14, and complete the fog burst with about one minute.

Moreover, the external device 44 may transmit a command to each protection system 10 designating an all-clear event if a threatening event has been thwarted or otherwise rendered safe. Upon receipt of the all-clear event command, each protection system 10 may stop generating and emitting fog 14, and return to its ready state in case a subsequent threatening event occurs.

This arrangement also allows the external device(s) 44 to receive status updates from each protection system 10, such as whether each protection system 10 is in its standby or ready state (e.g., whether its heat exchanger 36 is warmed up or cooled down), diagnostic information, whether a start-up event is detected, whether an all-clear event command is received, information on the supply levels of the volatile fluids in reservoir 32, ground power connection, battery charge, and the like. In some embodiments, controller 18 and communication unit 42 may also transmit emergency information to local law enforcement to inform them of a threatening event, and the location of the threatening event. This can assist in reducing response times for law enforcements to arrive at the scenes of the threatening events.

In some embodiments, controller 18 may also direct fog generator 20 to transition to a lock-down mode after a minimum duration has passed since the last start-up event was initiated (e.g., about forty seconds). In the lock-down mode, fog generator 20 preferably transitions to a lower fog generation rate (e.g., by partially closing flow regulator 34) that is sufficient to maintain the density of fog 14 in room 12. This allows fog generator 20 to replenish its supply of fog 14 in case a subsequent burst is required. Light sources 24, however, preferably continue to illuminate the existing fog 14 during the lock-down mode.

After a minimum duration has passed while in the lock-down mode, or when controller 18 receives an external command from an external device 44, protection system 10 may be reset to its ready state, where light sources 24 are shut off and fog generator 20 stops generating and emitting fog 14, but heat exchanger 36 remains warmed up state to its operating temperature for subsequent use.

Figure 4:
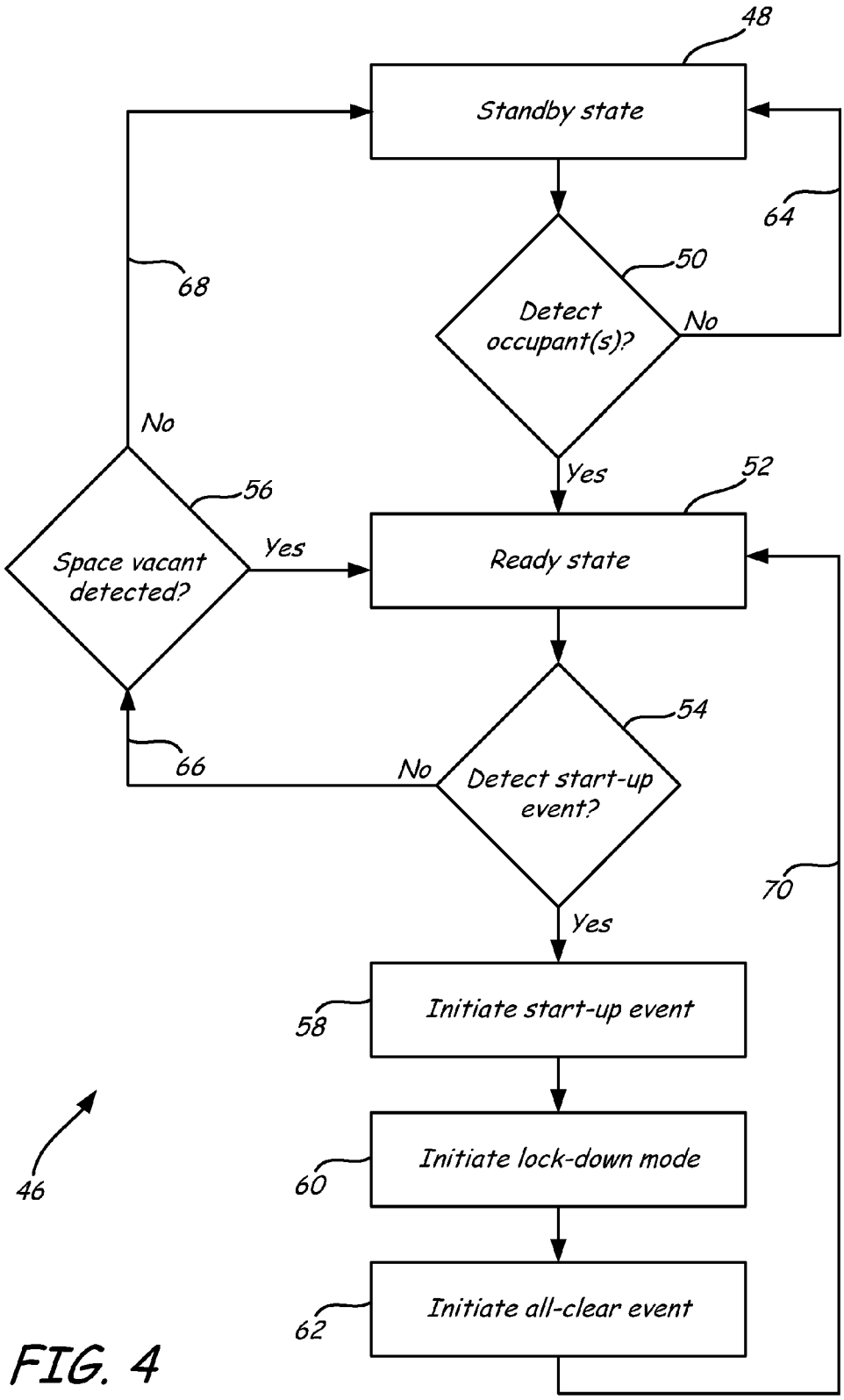
FIG. 4 is a flow diagram of a method for using the protection system.

FIG. 4 illustrates a flow diagram of method 46, which is an example method for using the protection systems of the present disclosure, such as protection system 10. As shown, method 46 includes steps 48-62, and initially involves maintaining protection system 10 in its standby state where heat exchanger 36 is cooled down to its standby temperature and controller 18 may monitor signals from gunfire sensor 28, occupant sensor 30, and communication unit 42 (step 48).

Occupant sensor 30 continues to monitor for any occupants in room 12 (step 50). If no occupants are detected, then controller 18 keeps protection system 10 in its standby state, as illustrated by return line 64. However, if one or more people enter room 12 and are detected by occupant sensor 30 (step 50), controller 18 may then direct heat exchanger 36 to warm up to its operating temperature to place protection system 10 in its ready state (step 52).

Controller 18 then continues to monitor signals from gunfire sensor 28, occupant sensor 30, and communication unit 42. If no start-up event is detected, such as detected gunfire or a start-up event command from an external device 44 is received (step 54), and if occupant sensor 30 stops detecting the presence of occupants in room 12 for a given duration (e.g., a thirty or sixty minute timeout period) (step 56), then controller 18 may cool heat exchanger 36 back down to its standby temperature to place protection system 10 in its standby state (step 48), as illustrated by return lines 66 and 68.

However, if occupant sensor 30 continues to detect the presence of occupants in room 12 (step 56), controller 18 preferably keeps protection system 10 in its ready state (step 52). While in the ready state, controller 18 continues to monitor signals from gunfire sensor 28. If no start-up event is detected, such as detected gunfire or a start-up event command from an external device 44 is received (step 54), controller 18 may continue to manage protection system 10 pursuant to steps 48-56.

However, if a start-up event is detected, such as gunfire being detected by gunfire sensor 28 or a start-up event command being received via communication unit 42 (step 54), controller 18 may initiate the start-up event, which involves generating and emitting fog 14 (or other obscuring haze) into room 12 and also preferably illuminating light sources 24 (step 58). In particular, controller 18 may direct flow regulator 34 to pump or otherwise regulate the flow of the volatile fluid from reservoir 32 into heat exchanger 36 maintained at its operating temperature. This vaporizes the volatile fluid, and directs the vaporized fluid to flow to manifold 38 and vent 22, where it condenses with cooler air to generate fog 14. The generated fog 14 is then rapidly emitted through manifold 38 and vent 22 into room 12.

As fog 14 fills rooms 12, the light from light sources 24 adds an additional level of obscuration. As discussed above, this combination of fog 14 and the light from light sources 24 prevents and firearm wielder from having line of sight contact with the occupants in room 12. This provides a measure of cover for the occupants while other assistance is being organized, and reduces the chances that the shooter will be able to accurately shoot any victim, increasing the odds of victim survival.

After a given duration (e.g., about forty seconds), controller 18 may initiate a lock-down mode where fog generator 20 preferably slows down the flow of fog 14 (e.g., partially closes flow regulator 34) (step 60), allowing fog generator 20 to replenish fog 14 in the event that another burst is required. At this point in the process, a substantial amount of fog 14 has already been generated and emitted into room 12. As such, a lower flow of fog 14 may be used to maintain the density of fog 14 in room 12. Light sources 24 preferably continue to shine light into the existing fog 14 in room 12 to assist in obscuring the occupants.

After operating in the lock-down mode for another duration, or when controller 18 receives an all-clear event command via an external device 44, controller 18 may initiate an all clear event (step 62) in which protection system 10 is brought back to its ready state (step 52) for subsequent use, as illustrated by return line 70.

As can be appreciated, protection system 10 is suitable for providing protective cover to occupants in a variety of locations where a firearm wielder may have easy line of sight with each person, rendering them easy targets. Protection system 10 may be deployed in any suitable location, such as school classrooms, offices, residential rooms, stores, restaurants, hotels, public transit stations and vehicles, political dignitary quarters, military buildings, law enforcement stations, and the like.

Because of its relative small size, protection system 10 may be retained in a given room in a non-intrusive manner. In fact, in some embodiments, housing 16 may include an aesthetically-pleasing appearance such that protection system 10 may blend into the décor of the room in which it is deployed. This can further prevent tampering by effectively hiding protection system 10 in plain view.

Moreover, by switching to a standby state when not needed, protection system 10 may also meet energy efficiency demands and reduced power costs that are important to many entities, such as school systems and businesses. This is in addition to its primary purpose of providing effective line of sight coverage that can increase the safety of room occupants in a variety of situations.

Although the present disclosure has been described with reference to preferred embodiments, workers skilled in the art will recognize that changes may be made in form and detail without departing from the spirit and scope of the disclosure.

The invention claimed is:

1. A protection system for deployment in an enclosed environment, the protection system comprising:

a haze generator;

a gunfire sensor configured to detect an occurrence of gunfire;

a communication unit configured to communicate with one or more external devices; and a controller in signal communication with the haze generator, the gunfire sensor, and the communication unit, and configured to manage the haze generator to generate and emit an obscuring haze into the enclosed environment in which the protection system is deployed in response to the detected occurrence of the gunfire by the gunfire sensor, in response to a transmitted command received by the communication unit, or a combination thereof, to obscure line of sight contact between an access point of the enclosed environment and occupants located in the enclosed environment.

2. The protection system of claim 1, and further comprising a housing, wherein at least the haze generator and the controller are retained in the housing.

3. The protection system of claim 2, and further comprising a vent in the housing that is configured to direct a flow of the emitted obscuring haze into the enclosed environment.

4. The protection system of claim 1, and further comprising an occupant sensor in signal communication with the controller and configured to detect a presence of the occupants in the enclosed environment, wherein the controller is further configured to switch the haze generator from a standby state to a ready state based on the detection at least one of the occupants in the enclosed environment by the occupant sensor.

5. The protection system of claim 1, and further comprising at least one light source, wherein the controller is further configured to illuminate the at least one light source in response to the detected occurrence of the gunfire by the gunfire sensor.

6. The protection system of claim 1, wherein the gunfire sensor comprises an electroacoustic transducer.

7. The protection system of claim 1, wherein the communication unit is further configured to transmit information from the controller to the one or more external devices.

8. The protection system of claim 1, wherein the haze generator is a heated fog generator comprising:

a reservoir configured to retain a supply of a volatile fluid; and a heat exchanger configured to receive, heat, and vaporize the volatile fluid.

9. A method of providing a protective cover to occupants of a room, the method comprising:

detecting a threatening event with a protection system deployed in the room, the threatening event comprising:

detecting an occurrence of gunfire with the protection system;

receiving a transmitted command of the threatening event by the protection system; or a combination thereof; and emitting an obscuring haze into the room from a haze generator of the protection system in response to the detected threatening event to obscure line of sight contact between an access point of the room and the occupants in the room.

10. The method of claim 9, and further comprising shining light into the emitted haze cloud with at least one light source of the protection system.

11. The method of claim 9, and further comprising:

detecting a presence of at least one of the occupants in the room; and switching the haze generator from a standby state to a ready state in response to the detected presence of the at least one occupant in the room.

12. The method of claim 9, wherein detecting the occurrence of gunfire with the protection system comprises:

detecting acoustic signals of the gunfire;

converting the detected acoustic signals to digital signals; and comparing the digital signals to predetermined patterns associated with acoustic signatures of gunfire.

13. The method of claim 12, wherein the predetermined patterns are selected from the group consisting of overpressure waveforms, acoustic frequencies, and combinations thereof.

14. The method of claim 9, and further comprising emitting obscuring hazes into adjacent rooms from haze generator of additional protection systems in response to the detected occurrence of the threatening event.

15. A method of providing a protective cover to occupants of a plurality of rooms, the method comprising:

deploying at least one protection system in each of the plurality of rooms, wherein each protection system comprises a haze generator;

managing an operating state of each protection system in response to occupant presence in the room in which the protection system is deployed such that the protection system is maintained in a ready state when occupants are in the room in which the protection system is deployed;

transmitting a command of a threatening event to at least a portion of the protection systems;

generating an obscuring haze from the haze generator of each protection system that receives the transmitted command; and emitting the generated obscuring haze into the room in which the protection system is deployed.

16. The method of claim 15, and further comprising illuminating the emitted obscuring haze with light emitters of each protection system that receives the transmitted command.

17. The method of claim 15, wherein the generated obscuring haze comprises fog.

18. The method of claim 15, and further comprising:

acoustically monitoring for an occurrence of gunfire with each protection system; and generating the obscuring haze from the haze generator of each protection system that detects the occurrence of gunfire.

19. The method of claim 18, wherein acoustically monitoring for the occurrence of gunfire with the protection system comprises:

detecting acoustic signals of the gunfire;

converting the detected acoustic signals to digital signals; and comparing the digital signals to predetermined patterns associated with acoustic signatures of gunfire, the predetermined patterns being selected from the group consisting of overpressure waveforms, acoustic frequencies, and combinations thereof.

20. The method of claim 18, and further comprising transmitting information from each protection system that detects the occurrence of gunfire to at least one external device.

* * * * *